US008483605B2

(12) United States Patent
Asaoka et al.

(10) Patent No.: US 8,483,605 B2
(45) Date of Patent: Jul. 9, 2013

(54) CLEANING DEVICE AND IMAGE FORMING APPARATUS INCLUDING SAME

(75) Inventors: Akira Asaoka, Kanagawa (JP); Takaya Muraishi, Kanagawa (JP); Kenji Sugiura, Kanagawa (JP); Hisashi Kikuchi, Kanagawa (JP); Yoshiki Hozumi, Kanagawa (JP); Yuu Sakakibara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 13/253,330

(22) Filed: Oct. 5, 2011

(65) Prior Publication Data

US 2012/0087704 A1 Apr. 12, 2012

(30) Foreign Application Priority Data

Oct. 6, 2010 (JP) ..... 2010-226552

(51) Int. Cl.
*G03G 21/00* (2006.01)
*G03G 15/16* (2006.01)

(52) U.S. Cl.
USPC ..... 399/354; 399/101

(58) Field of Classification Search
USPC ..... 399/99, 101, 349, 353, 354
See application file for complete search history.

(56) References Cited

U.S. PATENT DOCUMENTS 5,729,815 A * 3/1998 Lindblad et al. ..... 399/354
7,127,191 B2 * 10/2006 Mori et al. ..... 399/101
7,382,996 B2 * 6/2008 Lu et al. ..... 399/71
7,433,626 B2 * 10/2008 Takeuchi ..... 399/101
7,873,298 B2 * 1/2011 Yamashita et al. ..... 399/99
7,945,202 B2 * 5/2011 Kimura et al. ..... 399/353
8,045,881 B2 * 10/2011 Sano et al. ..... 399/101
2010/0008706 A1 * 1/2010 Sugiura et al. ..... 399/350
2011/0103822 A1 5/2011 Sugiura et al.
2011/0158677 A1 * 6/2011 Kikuchi et al. ..... 399/101

(Continued)

FOREIGN PATENT DOCUMENTS

JP 04330482 A * 11/1992
JP 09325623 A * 12/1997
JP 2002-202702 7/2002

(Continued)

OTHER PUBLICATIONS

U.S. Appl. No. 13/197,308, filed Aug. 3, 2011, Asaoka, et al.
U.S. Appl. No. 13/271,636, filed Oct. 12, 2011, Kikuchi, et al.

*Primary Examiner* — Robert Beatty
(74) *Attorney, Agent, or Firm* — Oblon, Spivak, McClelland, Maier & Neustadt, L.L.P.

(57) ABSTRACT

A cleaning device including a normally charged toner cleaning member provided in contact with a cleaning target at a contact position to remove normally charged toner from the cleaning target, a reversely charged toner cleaning member provided in contact with the cleaning target at a contact position upstream from the normally charged toner cleaning member to remove reversely charged toner from the cleaning target, and a pre-cleaning member provided in contact with the cleaning target at a contact position upstream from both the normally and reversely charged toner cleaning members to remove normally charged toner from the cleaning target. The contact position between the pre-cleaning member and the cleaning target has a width wider than a width of the contact position between the normally charged toner cleaning member and the cleaning target and a width of the contact position between the reversely charged toner cleaning member and the cleaning target.

13 Claims, 2 Drawing Sheets

U.S. PATENT DOCUMENTS

2011/0229187 A1* 9/2011 Hozumi et al. ..... 399/101
2011/0229234 A1 9/2011 Hozumi et al.
2012/0008973 A1* 1/2012 Sakakibara et al. ..... 399/71

FOREIGN PATENT DOCUMENTS

JP 2002221862 A * 8/2002
JP 2007-25173 2/2007

* cited by examiner

CLEANING DEVICE AND IMAGE FORMING APPARATUS INCLUDING SAME

CROSS-REFERENCE TO RELATED APPLICATIONS

The present patent application is based on and claims priority pursuant to 35 U.S.C. §119 from Japanese Patent Application No. 2010-226552, filed on Oct. 6, 2010, in the Japan Patent Office, which is incorporated by reference herein in its entirety.

BACKGROUND OF THE INVENTION

1. Field of the Invention

Exemplary aspects of the present invention generally relate to a cleaning device capable of maintaining long-lasting cleaning performance and an image forming apparatus including the cleaning device.

2. Description of the Background

Related-art image forming apparatuses, such as copiers, printers, facsimile machines, and multifunction devices having two or more of copying, printing, and facsimile functions, typically form a toner image on a transfer member (e.g., a sheet of paper, etc.) according to image data using an electrophotographic method. In such a method, for example, a charger charges a surface of a photoconductor; an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of transfer members; and a fixing device applies heat and pressure to the sheet bearing the toner image to fix the toner image onto the sheet. The sheet bearing the fixed toner image is then discharged from the image forming apparatus.

Toner having a smaller particle diameter and a round particle shape is now widely used in image forming apparatuses to meet increasing demand for higher-quality images. The smaller particle diameter can provide highly accurate and delicate images with higher resolution, and the round particle shape can achieve improved developing and transfer properties.

However, use of such toner prevents a well-known cleaning blade system from reliably cleaning the toner due to the following reasons.

In the cleaning blade system, a cleaning blade contacts a surface of an image carrier to scrape off the toner from the image carrier. At this time, the leading edge of the cleaning blade is deformed due to frictional resistance between the cleaning blade and the surface of the image carrier, resulting in stick-slip motion. Consequently, a minute space is generated between the cleaning blade and the image carrier.

The toner having the smaller particle diameter easily enters the minute space thus generated between the cleaning blade and the image carrier. In addition, when the toner entering the minute space has the round particle shape, torque tends to be generated at the toner, thereby rolling the toner within the minute space. As a result, smaller-diameter, round-particle toner lifts the cleaning blade. Consequently, the toner further easily enters the minute space between the cleaning blade and the image carrier. Thus, it is difficult to perform reliable cleaning of the toner using the well-known cleaning blade system.

One example of a method that can reliably clean even smaller-diameter, round-particle toner is an electrostatic cleaning method.

In the electrostatic cleaning method, a voltage having a polarity opposite a charging polarity of the toner is applied to a cleaning member such as a conductive cleaning brush contacting the image carrier, to electrostatically remove the toner from the image carrier.

However, any variation in the electric charge of untransferred toner conveyed to the cleaning member prevents the electrostatic cleaning method from reliably removing the toner from the image carrier, as described in detail below.

Much of the toner on the image carrier prior to transfer from the image carrier onto a transfer member such as a sheet of paper or other recording media is charged to a normal charging polarity of the toner, that is, a negative polarity. At a transfer position where the toner is transferred from the image carrier onto the sheet, a transfer magnetic field having a positive polarity opposite the normal charging polarity of the toner is applied to the toner borne on the image carrier to transfer the toner onto the sheet. However, a slight amount of toner remains attached to the image carrier after passing through the transfer position as untransferred toner.

The electric charge of the untransferred toner is shifted to the positive polarity due to the positive electric charge injected into the toner at the transfer position. Therefore, the untransferred toner remaining attached to the image carrier has a broad charging distribution having both the positively charged toner and the negatively charged toner.

However, in the electrostatic cleaning method described above, a positive voltage having a polarity opposite the normal charging polarity of the toner is applied to the cleaning brush as described above to electrostatically remove the toner from the image carrier. Consequently, it is difficult to remove the positively charged toner contained in the untransferred toner from the image carrier.

There is known a cleaning device in which a conductive blade is provided upstream from multiple cleaning brushes. The conductive blade contacts the image carrier and serves as a polarity controller that controls the charging polarity of the toner. A voltage having a polarity opposite a polarity of a voltage applied to a first cleaning brush is applied to the conductive blade.

Electric charges are injected into the untransferred toner from the conductive blade when the untransferred toner passes a contact position where the conductive blade contacts the image carrier. As a result, the untransferred toner is given the same charging polarity (usually the normal charging polarity of the toner) as the polarity of the voltage applied to the conductive blade.

Therefore, the untransferred toner that passes through the contact position and is further conveyed to the first cleaning brush has the same polarity as the polarity of the conductive blade, where it is electrostatically collected by the first cleaning brush to which a voltage having a polarity opposite the polarity of the voltage applied to the conductive blade is applied.

In the above-described example of the cleaning device, normally charged toner (e.g., negatively charged toner) on the image carrier is electrostatically attracted to the first cleaning brush serving as a normally charged toner cleaning member and is removed from the image carrier, and reversely charged toner (e.g., positively charged toner) on the image carrier is electrostatically attracted to a second cleaning brush serving as a reversely charged toner cleaning member and is removed from the image carrier.

As a result, both the positively and negatively charged toner can be removed from the image carrier.

However, in a case in which a toner pattern is formed on the image carrier to adjust an image density or to correct color shift, the image density is detected by a photosensor. After the detection of the image density, the toner pattern, which contains a larger amount of toner, is not transferred onto a sheet but is simply removed from the image carrier by the cleaning device.

In addition, in a case in which toner is consumed to replenish a developing device with new toner or irregular conveyance of the sheet causes sheet jam, a toner image containing a larger amount of toner formed on the image carrier is not transferred onto the sheet but is simply removed from the image carrier by the cleaning device.

Thus, the cleaning device removes the untransferred toner image such as the toner pattern containing a larger amount of toner, as well as the untransferred toner, from the image carrier.

However, the above-described related-art cleaning device cannot give a single charging polarity to the larger amount of toner contained in the untransferred toner image using the polarity controller. Consequently, toner having the same polarity as the polarity of the voltage applied to each of the cleaning brushes is conveyed to the respective cleaning brushes.

In addition, the larger amount of toner contained in the untransferred toner image may not be electrically attracted to the cleaning brushes. Consequently, the untransferred toner image is not reliably removed from the image carrier.

However, an electrostatic force in a repulsive direction relative to the normally charged toner acts on the second cleaning brush to which the negative voltage having the same polarity as the normal charging polarity of the toner is applied. Consequently, although the second cleaning brush has the higher ability to mechanically remove the toner from the image carrier, the bristles of the second cleaning brush do not contact the toner. As a result, some of the normally charged toner passes between the bristles of the brush, thereby preventing sufficient mechanical removal of the toner from the image carrier.

In addition, sometimes there is more positively charged toner than negatively charged toner contained in the untransferred toner. In such a case, the second cleaning brush having the smaller diameter and the lower ability to electrostatically remove the positively charged toner may not reliably remove the positively charged untransferred toner from the image carrier.

Further, there is also increasing demand for image forming apparatuses suitable for high-volume mass printing at reduced cost as well as higher quality images. In order to meet this demand, processing speed is increased, occurrence of downtime during maintenance or the like is reduced, and product life of consumable components is extended.

In a case of use of smaller-diameter, round-particle toner in the related-art cleaning blade system, the cleaning blade is pressed against the image carrier with a greater pressure to prevent the toner from entering the minute space between the cleaning blade and the image carrier. However, the larger load applied both to the cleaning blade and the image carrier due to the greater pressure easily wears the image carrier and the cleaning blade, thereby shortening the product life of the image carrier and the cleaning blade substantially. Consequently, the cleaning blade and the image carrier are required to be replaced more often. As a result, printing costs and occurrence of downtime due to replacement are increased and processing speed is decreased.

When irregular cleaning of the toner occurs in the above-described examples of the related-art cleaning devices, the cleaning devices are required to be replaced prematurely. As a result, similar to the related-art cleaning blade system, printing costs and occurrence of downtime due to replacement of the cleaning devices are increased and processing speed is decreased.

SUMMARY

In view of the foregoing, illustrative embodiments of the present invention provide a novel cleaning device capable of maintaining long-lasting cleaning performance that reduces maintenance and downtime, and a novel image forming apparatus including the cleaning device.

In one illustrative embodiment, a cleaning device includes: a normally charged toner cleaning member, to which a voltage having a polarity opposite a normal charging polarity of toner is applied, provided in contact with a rotatable cleaning target at a contact position to electrostatically remove normally charged toner from the cleaning target; a reversely charged toner cleaning member, to which a voltage having the same polarity as the normal charging polarity of the toner is applied, provided in contact with the cleaning target at a contact position upstream from the normally charged toner cleaning member in a direction of rotation of the cleaning target to electrostatically remove reversely charged toner from the cleaning target; and a pre-cleaning member, to which a voltage having the polarity opposite the normal charging polarity of the toner is applied, provided in contact with the cleaning target at a contact position upstream from both the normally charged toner cleaning member and the reversely charged toner cleaning member in the direction of rotation of the cleaning target to electrostatically remove normally charged toner from the cleaning target. The contact position between the pre-cleaning member and the cleaning target in the direction of rotation of the cleaning target has a width wider than each of a width of the contact position between the normally charged toner cleaning member and the cleaning target and a width of the contact position between the reversely charged toner cleaning member and the cleaning target in the direction of rotation of the cleaning target.

Another illustrative embodiment provides an image forming apparatus including the cleaning device described above.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
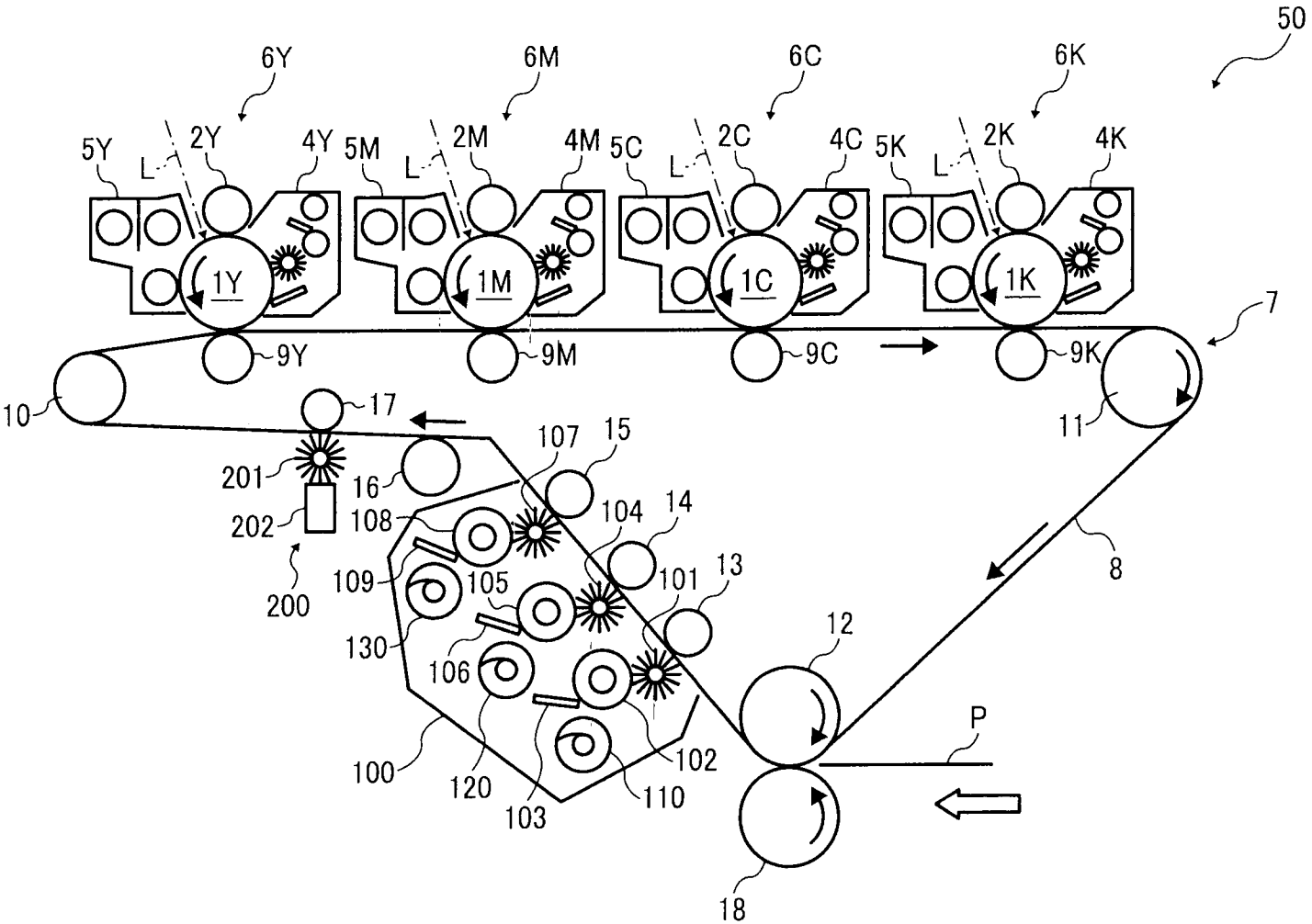
FIG. 1 is a vertical cross-sectional view illustrating an example of a configuration of a main part of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A basic configuration and operation of a tandem type full-color printer employing an intermediate transfer system serving as an image forming apparatus 50 according to illustrative embodiments are described in detail below.

FIG. 1 is a vertical cross-sectional view illustrating an example of a configuration of a main part of the image forming apparatus 50. The image forming apparatus 50 includes four process units 6Y, 6M, 6C, and 6K (hereinafter collectively referred to as process units 6) that form a toner image of a specific color, that is, yellow (Y), magenta (M), cyan (C), or black (K).

The process units 6 includes drum-shaped photoconductors 1Y, 1M, 1C, and 1K (hereinafter collectively referred to as photoconductors 1), respectively. Chargers 2Y, 2M, 2C, and 2K (hereinafter collectively referred to as chargers 2), developing devices 5Y, 5M, 5C, and 5K (hereinafter collectively referred to as developing devices 5), drum cleaning devices 4Y, 4M, 4C, and 4K (hereinafter collectively referred to as drum cleaning devices 4), neutralizing devices, not shown, and so forth are provided around the photoconductors 1, respectively.

Each of the four process units 6 has the same basic configuration, differing only in the color of toner used. An optical writing unit, not shown, that directs laser light L onto surfaces of the photoconductors 1 to form electrostatic latent images on the surfaces of the photoconductors 1 is provided above the process units 6.

A transfer unit 7 including an endless intermediate transfer belt 8 serving as an image carrier or a cleaning target is provided below the process units 6.

The image forming apparatus 50 further includes multiple extension rollers provided inside a loop of the intermediate transfer belt 8 and components provided outside the loop of the intermediate transfer belt 8, such as a secondary transfer roller 18, a tension roller 16, a belt cleaning device 100, and a lubricant applicator 200.

The multiple extension rollers include four primary transfer rollers 9Y, 9M, 9C, and 9K (hereinafter collectively referred to as primary transfer rollers 9), a driven roller 10, a drive roller 11, a secondary transfer opposing roller 12, first, second, and third opposing roller 13, 14, and 15, and an applicator opposing roller 17.

The intermediate transfer belt 8 is wound around each of the above-described multiple extension rollers.

It is to be noted that the first, second, and third opposing rollers 13, 14, and 15 apply a predetermined amount of tension to the intermediate transfer belt 8 but need not necessarily do so, and may be driven by rotation of the intermediate transfer belt 8.

The intermediate transfer belt 8 is rotated in a clockwise direction in FIG. 1 by rotation of the drive roller 11 rotatively driven in the clockwise direction by drive means, not shown.

The primary transfer rollers 9 are provided opposite the photoconductors 1 with the intermediate transfer belt 8 interposed therebetween. Accordingly, primary transfer nips are formed where the intermediate transfer belt 8 contacts each of the photoconductors 1.

It is to be noted that a primary transfer bias having a polarity opposite a polarity of toner is supplied from a power source, not shown, to each of the primary transfer rollers 9.

The secondary transfer opposing roller 12 is provided opposite the secondary transfer roller 18 with the intermediate transfer belt 8 interposed therebetween. Accordingly, a secondary transfer nip is formed where the intermediate transfer belt 8 contacts the secondary transfer roller 18.

It is to be noted that a secondary transfer bias having a polarity opposite the polarity of toner is supplied from a power source, not shown, to the secondary transfer roller 18. Alternatively, a conveyance belt that conveys a sheet may be wound around the secondary transfer roller 18 and another rollers. In such a case, the secondary transfer roller 18 is provided opposite the secondary transfer opposing roller 12 with both the intermediate transfer belt 8 and the conveyance belt interposed therebetween.

The first, second, and third opposing rollers 13, 14, and 15 are provided opposite first, second, and third cleaning brush rollers 101, 104, and 107 of the belt cleaning device 100, respectively, with the intermediate transfer belt 8 interposed therebetween.

Accordingly, cleaning nips are formed where the intermediate transfer belt 8 contacts each of the first, second, and third cleaning brush rollers 101, 104, and 107. A configuration of the belt cleaning device 100 is described in detail later.

The image forming apparatus 50 further includes a sheet feeder, not shown. The sheet feeder includes a sheet feed cassette that stores a sheet P and a sheet feed roller that feeds the sheet P from the sheet feed cassette to a sheet feed path in the image forming apparatus 50. A pair of registration rollers, not shown, is provided upstream of the secondary transfer nip to temporarily stop conveyance of the sheet P fed from the sheet feeder to convey the sheet P to the secondary transfer nip at a predetermined timing.

The sheet P is further conveyed from the secondary transfer nip to a fixing device, not shown, provided downstream of the secondary transfer nip to fix a toner image onto the sheet P.

The image forming apparatus 50 further includes a toner supplier that supplies toner to the developing devices 5 as needed.

In addition to the plain paper that is widely used as the sheet P, special paper such as paper having an uneven surface and iron-on print paper used for thermal transfer is often used in recent years.

Use of such special paper more often causes irregular secondary transfer of the toner image from the intermediate transfer belt 8 compared to use of the plain paper.

Therefore, in the image forming apparatus 50, the intermediate transfer belt 8 is provided with a certain elasticity to be deformable at the secondary transfer nip in conformity with the toner image or the uneven surface of the sheet P.

Specifically, the intermediate transfer belt 8 is constructed of at least a base layer, an elastic layer on the base layer, and a surface coating layer provided on the elastic layer.

As a result, the intermediate transfer belt 8 can fully contact the uneven surface of the sheet P without an excessive transfer pressure at the secondary transfer nip, thereby preventing irregular transfer of the toner image. Thus, the toner image is evenly transferred onto the uneven surface of the sheet P, thereby providing a higher-quality image having even image density.

The elastic layer of the intermediate transfer belt 8 is formed of an elastic material. Specific examples of the elastic material include, but are not limited to, elastic rubber, elastomer, butyl rubber, fluororubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrine rubber, polysulfide rubber, polynorbornene rubber, and thermoplastic elastomer (e.g., polystyrene resin, polyolefin resin, polyvinyl chloride resin, polyurethane resin, polyamide resin, polyurea resin, polyester resin, or fluorocarbon resin). These materials can be used alone or in combination.

Although depending on the hardness and the structure of the intermediate transfer belt 8, a thickness of the elastic layer is preferably from 0.07 mm to 0.5 mm, and more preferably from 0.25 mm to 0.5 mm. When the intermediate transfer belt 8 is thinner than 0.07 mm, pressure acting on the toner on the intermediate transfer belt 8 at the secondary transfer nip is increased and transfer defects tend to occur, thereby degrading transfer efficiency of the toner.

It is preferable that the elastic layer have a JIS-A hardness of from 10° to 65°. Although the optimal hardness of the elastic layer depends on the thickness of the intermediate transfer belt 8, a hardness lower than the JIS-A hardness of 10° tends to cause transfer defects. By contrast, a hardness higher than the JIS-A hardness of 65° makes the intermediate transfer belt 8 difficult to be wound around the rollers. Further, the intermediate transfer belt 8 is stretched over time, thereby degrading durability and causing frequent replacement.

The base layer of the intermediate transfer belt 8 is formed of resin with less stretch. Specific examples of the materials used for the base layer include, but are not limited to, one or more of polycarbonate, fluorocarbon resin (e.g. ETFE or PVDF), polystyrene, chloropolystyrene, poly-α-methylstyrene, styrene-budadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyle acrylate copolymer or styrene-phenyl acrylate copolymer), styrene-methacrylate copolymer (e.g. styrene-methyl methacrylate, styrene-ethyl methacrylate copolymer or styrene-phenyl methacrylate copolymer), styrene-α-methyl chloroacrylate copolymer, styrene-acrylonitrile-acrylate copolymer or similar styrene resin (e.g. polymer or copolymer containing styrene or substituted styrene), methyl methacrylate resin, butyl methacrylate resin, ethyl acrylate resin, butyl acrylate resin, modified acrylic resin (silicone modified acrylic resin, vinyl chloride resin modulated acrylic resin or acryl-urethane resin), vinyl chloride resin, styrene-vinyl acetate resin copolymer, vinyl chloride-vinyl acetate copolymer, rosin modulated maleic ester resin, phenol resin, epoxy resin, polyester resin, polyester-polyurethane resin, polyethylene, polypropylene, polybudadiene, polyvinylidene chloride, ionomer resin, polyurethane resin, silicone resin, ketone resin, ethylene-etyl acrylate copolymer, xylene resin, polyvinyl butyral resin, polyamide resin, and modified polyphenylene oxide resin.

It is to be note that, in order to prevent stretching of the elastic layer formed of the rubber material with a larger stretch, a core layer formed of a material such as a canvas may be provided between the base layer and the elastic layer of the intermediate transfer belt 8.

Specific examples of the material used for the core layer include, but are not limited to, natural fibers such as cotton and silk, synthetic fibers such as polyester fibers, nylon fibers, acrylic fibers, polyorefine fibers, polyvinyl alcohol fibers, polyvinyl chloride fibers, polyvinylidene chloride fibers, polyurethane fibers, polyacetal fibers, polyfluoroethylene fibers, and phenol fibers, inorganic fibers such as carbon fibers and glass fibers, metal fibers such as iron fibers and copper fibers, and combinations of two or more of the above-described materials. The fibers may be configured as threads or textile and may be twisted in any suitable manner. The threads may be processed to have conductivity.

The textile may be woven in any suitable manner such as tockinette, and may be provided with conductivity.

The surface of the elastic layer of the intermediate transfer belt 8 is coated with the surface coating layer having smoothness. Although not particularly limited to, materials that reduce adhesion of the toner to the surface of the intermediate transfer belt 8 to improve the secondary transfer efficiency is generally used for the surface coating layer.

Specific examples of materials used for the surface coating layer include, but are not limited to, polyurethane resin, polyester resin, epoxy resin, and combinations of two or more of the above-described materials. Alternatively, a material that reduces surface energy to improve lubricating property, such as fluorocarbon resin grains, fluorine compound grains, carbon fluoride grains, titanium oxide grains, and silicon carbide grains with or without the grain size being varied may be used alone or in combination.

Further, fluororubber may be heated to form a fluorine layer on the surface thereof, thereby reducing surface energy.

In order to adjust resistance, each of the base layer, the elastic layer, and the surface coating layer may be formed of metal powder such as carbon black, graphite, aluminum, and nickel, conductive metal oxides such as tin oxide, titanium oxide, antimony oxide, indium oxide, potassium titanate, ATO (antimony oxide-tin oxide), ITO (indium oxide-tin oxide), or the like.

The conductive metal oxide may be coated with insulative fine grains such as, but are not limited to, barium sulfate, magnesium silicate, or calcium carbonate.

The lubricant applicator 200 supplies a lubricant to the surface of the intermediate transfer belt 8 to protect the surface of the intermediate transfer belt 8. The lubricant applicator 200 includes a solid lubricant 202 formed of zinc stearate and an application brush roller 201 serving as an application member. The application brush roller 201 rotatively contacts the solid lubricant 202 to supply lubricant powder scraped off from the lubricant 202 to the surface of the intermediate transfer belt 8.

Upon receipt of image data, the image forming apparatus 50 rotatively drives the drive roller 11 to rotate the intermediate transfer belt 8. The extension rollers other than the drive roller 11 are driven by the rotation of the intermediate transfer belt 8 itself.

At the same time, the photoconductors 1 are rotatively driven. The chargers 2 evenly charge the surfaces of the photoconductors 1, and the laser light L is directed onto the charged surfaces of the photoconductors 1 to form electrostatic latent images on the surfaces of the photoconductors 1, respectively.

The electrostatic latent images thus formed on the surfaces of the photoconductors 1 are developed by the developing devices 5 so that toner images of the respective colors are formed on the surfaces of the photoconductors 1.

The toner images of the respective colors are primarily transferred onto the intermediate transfer belt 8 at the primary transfer nips, respectively, and sequentially superimposed one atop the other to form a full-color toner image on the intermediate transfer belt 8.

Meanwhile, in the sheet feeder, the sheet P is fed one by one from the sheet feed cassette by the sheet feed roller to be conveyed to the pair of registration rollers. The pair of registration rollers is driven such that the sheet P is conveyed to the secondary transfer nip in synchronization with the full-color toner image formed on the intermediate transfer belt 8. Accordingly, the full-color toner image is secondarily transferred from the intermediate transfer belt 8 onto the sheet P.

Thus, the full-color toner image is formed on the sheet P. The sheet P bearing the full-color toner image thereon is then conveyed from the secondary transfer nip to the fixing device to fix the full-color toner image onto the sheet P.

The drum cleaning devices 4 remove residual toner from the surfaces of the photoconductors 1, respectively, after primary transfer of the toner images from the surfaces of the photoconductors 1 onto the intermediate transfer belt 8. Thereafter, the neutralizing devices neutralize the surfaces of the photoconductors 1, and then the chargers 2 evenly charge the surfaces of the photoconductors 1 to be ready for the next sequence of image formation.

The belt cleaning device 100 removes from the intermediate transfer belt 8 untransferred toner which is not transferred onto the sheet P and still remains on the intermediate transfer belt 8 after secondary transfer of the full-color toner image from the intermediate transfer belt 8 onto the sheet P.

Figure 2:
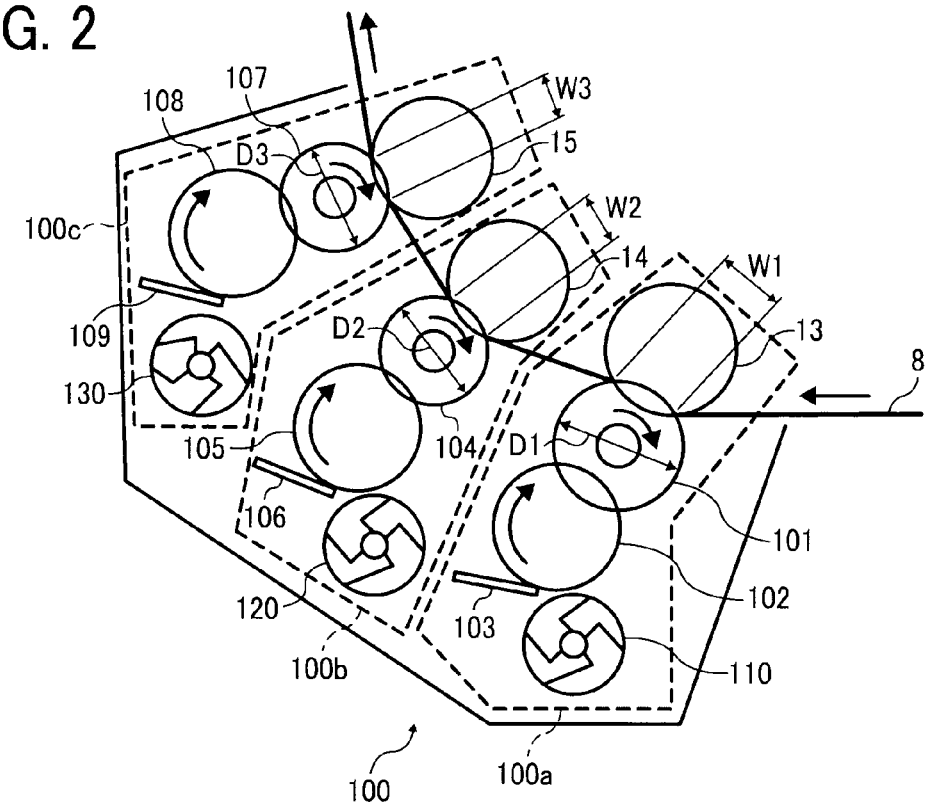
FIG. 2 is a vertical cross-sectional view illustrating an example of a configuration of a belt cleaning device and surrounding components included in an image forming apparatus according to a first illustrative embodiment.

FIG. 2 is a vertical cross-sectional view illustrating an example of a configuration of the belt cleaning device 100 and surrounding components according to a first illustrative embodiment.

The belt cleaning device 100 includes a pre-cleaning part (first cleaning part) 100*a* that removes much of untransferred toner from the intermediate transfer belt 8, a reversely charged toner cleaning part (second cleaning part) 100*b* that removes positively charged toner having a polarity opposite a normal charging polarity of the toner from the intermediate transfer belt 8, and a normally charged toner cleaning part (third cleaning part) 100*c* that removes negatively charged toner having a normal charging polarity of the toner from the intermediate transfer belt 8.

The first cleaning part 100*a* includes a pre-cleaning brush roller (first cleaning brush roller) 101 serving as a pre-cleaning member. The first cleaning part 100*a* further includes a pre-collection roller (first collection roller) 102 serving as a pre-collection member that collects toner attached to the first cleaning brush roller 101 and a pre-scraping blade (first scraper) 103 that contacts the first collection roller 102 to scrape off the toner from a surface of the first collection roller 102.

Much of the untransferred toner is normally charged to the negative polarity. Therefore, a voltage having a polarity opposite the normal charging polarity of the toner, that is, the positive voltage, is applied to the first cleaning brush roller 101 to electrostatically remove the negatively charged toner from the intermediate transfer belt 8.

In addition, a positive voltage greater than the voltage applied to the first cleaning brush roller 101 is applied to the first collection roller 102. In the belt cleaning device 100, the voltage applied to the first cleaning brush roller 101 is set such that 90% of the untransferred toner is removed from the intermediate transfer belt 8 by the first cleaning brush roller 101.

The first cleaning part 100*a* further includes a conveyance screw 110 that conveys the collected toner to a waste toner tank, not shown, provided to the image forming apparatus 50.

The second cleaning part 100*b* is provided downstream from the first cleaning part 100*a* in the direction of rotation of the intermediate transfer belt 8, and includes a reversely charged toner cleaning brush roller (second cleaning brush roller) 104 serving as a reversely charged toner cleaning member that electrostatically removes reversely charged toner (e.g., positively charged toner) charged to the polarity opposite the normal charging polarity of the toner from the intermediate transfer belt 8.

The second cleaning part 100*b* further includes a reversely charged toner collection roller (second collection roller) 105 serving as a reversely charged toner collection member that collects the positively charged toner attached to the second cleaning brush roller 104 and a reversely charged toner scraping blade (second scraper) 106 that contacts the second collection roller 105 to scrape off the positively charged toner from a surface of the second collection roller 105.

A negative voltage is applied to the second cleaning brush roller 104. In addition, a negative voltage greater than the negative voltage applied to the second cleaning brush roller 104 is applied to the second collection roller 105.

The second cleaning part 100*b* functions also as a polarity controller that supplies negative electric charges to the toner on the intermediate transfer belt 8 to give the toner on the intermediate transfer belt 8 the normal charging polarity, that is, the negative polarity.

The second cleaning part 100*b* further includes a conveyance screw 120 that conveys the collected toner to a waste toner tank, not shown, provided to the image forming apparatus 50.

The third cleaning part 100*c* is provided downstream from the second cleaning part 100*b* in the direction of rotation of the intermediate transfer belt 8, and includes a normally charged toner cleaning brush roller (third cleaning brush roller) 107 serving as a normally charged toner cleaning member that electrostatically removes the negatively charged toner from the intermediate transfer belt 8.

The third cleaning part 100*c* further includes a normally charged toner collection roller (third collection roller) 108 serving as a normally charged toner collection member that collects the negatively charged toner attached to the third cleaning brush roller 107 and a normally charged toner scraping blade (third scraper) 109 that contacts the third collection roller 108 to scrape off the negatively charged toner from a surface of the third collection roller 108.

A positive voltage is applied to the third cleaning brush roller 107. In addition, a positive voltage greater than the positive voltage applied to the third cleaning brush roller 107 is applied to the third collection roller 108.

The third cleaning part 100*c* further includes a conveyance screw 130 that conveys the collected toner to a waste toner tank, not shown, provided to the image forming apparatus 50.

Each of the first, second, and third cleaning brush rollers 101, 104, and 107 is constructed of a metal rotary shaft rotatably supported and a brush part formed of multiple bristles provided to a circumference of the metal rotary shaft. Each of the multiple bristles constructing the brush parts of the first, second, and third cleaning brush rollers 101, 104, and 107 has a core-in-sheath type structure, in which a conductive material such as conductive carbon is dispersed in an insulating material such as polyester provided in a surface layer of the bristle.

Accordingly, a core of the bristle has an electric potential substantially the same as the voltage applied to each of the cleaning brush rollers 101, 104, and 107, thereby electrostatically attracting the toner to the surface of the bristle. Thus, the toner on the intermediate transfer belt 8 is electrostatically attached to the bristles by the voltage applied to each of the cleaning brush rollers 101, 104, and 107.

It is to be noted that, in place of the bristles having a core-in-sheath type structure, the bristles of the cleaning brush rollers 101, 104, and 107 may be formed of a conductive material only. In addition, the bristles may be transplanted to the rotary shaft of each of the cleaning brush rollers 101, 104, and 107 at an angle thereto, in a direction of a normal line of the rotary shaft.

Further alternatively, the bristles of the first and third cleaning brush roller 101 and 107 may have a core-in-sheath type structure while the bristles of the second cleaning brush roller 104 may be formed of conductive bristles only.

The bristles of the second cleaning brush roller 104 formed only of the conductive material can easily inject electrical charges into the toner. As a result, the toner on the intermediate transfer belt 8 can be reliably given the negative polarity by the second cleaning brush roller 104.

Meanwhile, the core-in-sheath type structure of the bristles in the first and third cleaning brush rollers 101 and 107 can suppress charge injection into the toner, thereby preventing the toner on the intermediate transfer belt 8 from being positively charged.

Accordingly, generation of residual toner which is not electrostatically removed from the intermediate transfer belt 8 by the first or third cleaning brush roller 101 or 107 can be prevented.

In the present embodiment, a stainless-steel roller is used for each of the first, second, and third collection rollers 102, 105, and 108. It is to be noted that any material may be used for the collection rollers 102, 105, and 108 as long as the toner attached to the cleaning brush rollers 101, 104, and 107 is translocated to the collection rollers 102, 105, and 108, respectively, using the electric potential difference between the collection rollers 102, 105, and 108 and the bristles of the cleaning brush rollers 101, 104, and 107.

For example, a conductive metal core of each of the collection rollers 102, 105, and 108 may be coated with a high-resistance elastic tube having a thickness of from several μm to 100 μm and be further coated with an insulating material, such that each of the collection rollers 102, 105, and 108 has a roller resistance logR of from 12Ω to 13Ω.

Use of the stainless-steel roller for each of the collection rollers 102, 105, and 108 can reduce production costs, applied voltages, and power consumption.

Further, setting the roller resistance logR to the above-described range from 12Ω to 13Ω suppresses charge injection into the toner upon collection of the toner from the cleaning brush rollers 101, 104, and 107 to the collection rollers 102, 105, and 108. As a result, the toner is prevented from being given the same polarity as the polarity of the voltage applied to each of the collection rollers 102, 105, and 108. Therefore, the toner is reliably collected by the collection rollers 102, 105, and 108.

Each of the cleaning brush rollers 101, 104, and 107 is set as follows. As described above, the bristles of each of the cleaning brush rollers 101, 104, and 107 are formed of conductive polyester and have a core-in-sheath type structure. Each of the cleaning brush rollers 101, 104, and 107 has a resistivity of from $10^6\Omega$ to $10^8\Omega$ and a density of 100,000 bristles per square inch. Each of the brush bristles has a diameter of from about 25 μm to 35 μm, and a leading edge of each of the brush bristles is bent. A first cleaning bias of from +1,600 V to +2,000 V is applied to the rotary shaft of the first cleaning brush roller 101. A second cleaning bias of from −2,000 V to −2,400 V is applied to the rotary shaft of the second cleaning brush roller 104. A third cleaning bias of from +800 V to +1,200 V is applied to the rotary shaft of the third cleaning brush roller 107.

The voltage applied to the first cleaning brush roller 101 is set such that even an untransferred toner image having a larger amount of toner such as a toner pattern formed for controlling imaging conditions can be reliably removed from the intermediate transfer belt 8.

In addition, an absolute value of the voltage applied to the second cleaning brush roller 104 is set slightly higher to inject negative electric charges into the positively charged toner on the intermediate transfer belt 8.

The configuration of the cleaning brush rollers 101, 104, and 107 is not limited to the above-described example, and may be varied as appropriate depending on the system. Examples of materials for use in the bristles are, but are not limited to, nylon, acrylic, and polyester.

As described above, the metal core of each of the collection rollers 102, 105, and 108 is formed of stainless steel. The bristles of each of the cleaning brush rollers 101, 104, and 107 contact the collection rollers 102, 105, and 108 with an engagement of 1.5 mm, respectively. A first collection bias of from +2,000 V to +2,400 V is applied to the metal core of the first collection roller 102. A second collection bias of from −2,400 to −2,800 is applied to the metal core of the second collection roller 105. A third collection bias of from +1,000 to +1,400 is applied to the metal core of the third collection roller 108.

As with the cleaning brush rollers 101, 104, and 107, the configuration of the collection rollers 102, 105, and 108 is not limited to the above-described example, and may be varied as appropriate depending on the system.

Each of the first, second, and third scrapers 103, 106, and 109 has a thickness of 0.1 mm and contacts the surfaces of the collection rollers 102, 105, and 108 with an engagement of 1.0 mm, respectively, to face in the rotation direction of the collection rollers 102, 105, and 108 at a contact angle of 20°.

It is to be noted that the configuration of the scrapers 103, 106, and 109 is not limited to the above-described example, and may be varied as appropriate depending on the system.

Each of the cleaning brush rollers 101, 104, and 107 is rotated by drive means, not shown, such that the bristles of each of the cleaning brush rollers 101, 104, and 107 are moved in a direction opposite the direction of rotation of the intermediate transfer belt 8 at contact positions where the bristles contact the intermediate transfer belt 8.

Accordingly, a difference in linear velocity between the intermediate transfer belt 8 and each of the cleaning brush rollers 101, 104, and 107 can be increased at the contact positions. As a result, the bristles of each of the cleaning brush rollers 101, 104, and 107 can more reliably contact the intermediate transfer belt 8 at the contact positions, thereby more preferably removing the toner from the intermediate transfer belt 8.

In the first illustrative embodiment, a width of the contact position where the first cleaning brush roller 101 and the intermediate transfer belt 8 contact each other (hereinafter referred to as a contact width W1) is larger than each of a width of the contact position where the second cleaning brush roller 104 and the intermediate transfer belt 8 contact each other (hereinafter referred to as a contact width W2) and a width of the contact position where the third cleaning brush roller 107 and the intermediate transfer belt 8 contact each other (hereinafter referred to as a contact width W3).

Thus, a period of time in which the first cleaning brush roller 101, to which the largest amount of toner is conveyed, and the intermediate transfer belt 8 contact each other is extended, thereby maximizing a contact probability between the first cleaning brush roller 101 and the intermediate transfer belt 8. In addition, mechanical cleaning performance of the first cleaning brush roller 101 is optimized to reliably remove the toner from the intermediate transfer belt 8. As a result, stable cleaning performance is provided for a longer period of time even when the bristles of the first cleaning brush roller 101 are deteriorated over time.

In order to achieve the above-described relation between the contact widths W1, W2, and W3, an outer diameter D1 of the first cleaning brush roller 101 is larger than each of an outer diameter D2 of the second cleaning brush roller 104 and an outer diameter D3 of the third cleaning brush roller 107.

A description is now given of operation of the belt cleaning device 100.

The untransferred toner or the untransferred toner image on the intermediate transfer belt 8 passing through the secondary transfer position is conveyed to the first cleaning brush roller 101 by rotation of the intermediate transfer belt 8.

As described above, a positive voltage is applied to the first cleaning brush roller 101. Accordingly, the negatively charged toner on the intermediate transfer belt 8 is electrostatically attached to the first cleaning brush roller 101 by an electric field formed by a potential difference between the intermediate transfer belt 8 and the first cleaning brush roller 101.

Then, the negatively charged toner attached to the first cleaning brush roller 101 is conveyed to a contact position where the first cleaning brush roller 101 contacts the first collection roller 102, to which a positive voltage greater than the voltage applied to the first cleaning brush roller 101 is applied.

At the contact position, the toner on the first cleaning brush roller 101 is electrostatically attached to the first collection roller 102 by an electric field formed by a potential difference between the first cleaning brush roller 101 and the first collection roller 102. The negatively charged toner thus attached to the first collection roller 102 is then scraped off from the first collection roller 102 by the first scraper 103.

The toner thus scraped off is discharged from the belt cleaning device 100 by the conveyance screw 110.

Toner which cannot be removed by the first cleaning brush roller 101 and the positively charged residual toner that still remains on the intermediate transfer belt 8 after passing through the first cleaning brush roller 101 are further conveyed to the second cleaning brush roller 104.

As described above, a negative voltage is applied to the second cleaning brush roller 104. Accordingly, the positively charged toner on the intermediate transfer belt 8 is electrostatically attached to the second cleaning brush roller 104 by an electric field formed by a potential difference between the intermediate transfer belt 8 and the second cleaning brush roller 104.

At the same time, the toner remaining on the intermediate transfer belt 8 is given a negative polarity by charge injection or electric discharge. The positively charged toner attached to the second cleaning brush roller 104 is conveyed to a contact position where the second cleaning brush roller 104 contacts the second collection roller 105, to which a negative voltage greater than the voltage applied to the second cleaning brush roller 104 is applied.

The positively charged toner on the second cleaning brush roller 104 is electrostatically attached to the second collection roller 105 by an electric field formed by a potential difference between the second cleaning brush roller 104 and the second collection roller 105.

Then, the positively charged toner thus attached to the second collection roller 105 is scraped off from the second collection roller 105 by the second scraper 106. The toner thus scraped off is discharged from the belt cleaning device 100 by the conveyance screw 120.

Thereafter, the toner which is negatively charged by the second cleaning brush roller 104 and the negatively charged toner that cannot be removed by the first cleaning brush roller 101 and still remains on the intermediate transfer belt 8 after passing through the second cleaning brush roller 104 are further conveyed to the third cleaning brush roller 107.

As described above, the toner thus conveyed to the third cleaning brush roller 107 is given a negative polarity by the second cleaning brush roller 104. In addition, by this time most of the toner has already been removed from the intermediate transfer belt 8 by the first and second cleaning brush rollers 101 and 104.

Therefore, only a slight amount of toner is conveyed to the third cleaning brush roller 107. The slight amount of the negatively charged toner on the intermediate transfer belt 8 conveyed to the third cleaning brush roller 107 is electrostatically attached to the third cleaning brush roller 107, to which a positive voltage is applied. Thereafter, the toner is collected by the third collection roller 108, and is scraped off from the third collection roller 108 by the third scraper 109.

The toner thus scraped off is discharged from the belt cleaning device 100 by the conveyance screw 130.

Thus, much of the negatively charged toner that accounts for a majority of the untransferred toner or the untransferred toner image is removed from the intermediate transfer belt 8 by the first cleaning brush roller 101 in the belt cleaning device 100.

Accordingly, an amount of toner conveyed to the second or third cleaning brush roller 104 or 107 can be reduced.

As a result, there is no such a case in which a large amount of toner remains on the intermediate transfer belt 8 without being removed from the intermediate transfer belt 8 by the first cleaning brush roller 101 and prevents attachment of the positively charged toner to the second cleaning brush roller 104. Therefore, the positively charged toner is reliably removed from the intermediate transfer belt 8 by the second cleaning brush roller 104.

By this time, most of the toner has already been removed from the intermediate transfer belt 8 by the first and second cleaning brush rollers 101 and 104. Therefore, only a slight amount of toner is conveyed to the third cleaning brush roller 107.

The slight amount of toner thus conveyed to the third cleaning brush roller 107 is given a negative polarity by the second cleaning brush roller 104. Therefore, the third cleaning brush roller 107 reliably removes the slight amount of negatively charged toner from the intermediate transfer belt 8.

Thus, even the untransferred toner image having a larger amount of toner can be reliably removed from the intermediate transfer belt 8 by the belt cleaning device 100.

In a case of use of a related-art belt cleaning device, a larger amount of toner conveyed to the belt cleaning device may not be reliably removed by the cleaning device, resulting in irregular cleaning of the toner. In addition, long-term use of the related-art belt cleaning device may not provide higher cleaning performance.

By contrast, the belt cleaning device 100 according to the present embodiment can maximize the contact width W1 between the first cleaning brush roller 101, to which the largest cleaning load is applied, and the intermediate transfer belt 8. Accordingly, even a larger amount of toner conveyed to the belt cleaning device 100 can be reliably removed from the intermediate transfer belt 8 by the first cleaning brush roller 101. In addition, the belt cleaning device 100 can maintain higher cleaning performance for a longer period of time. As a result, printing costs, maintenance costs, and occurrence of downtime due to maintenance can be reduced and productivity is improved.

Figure 3:
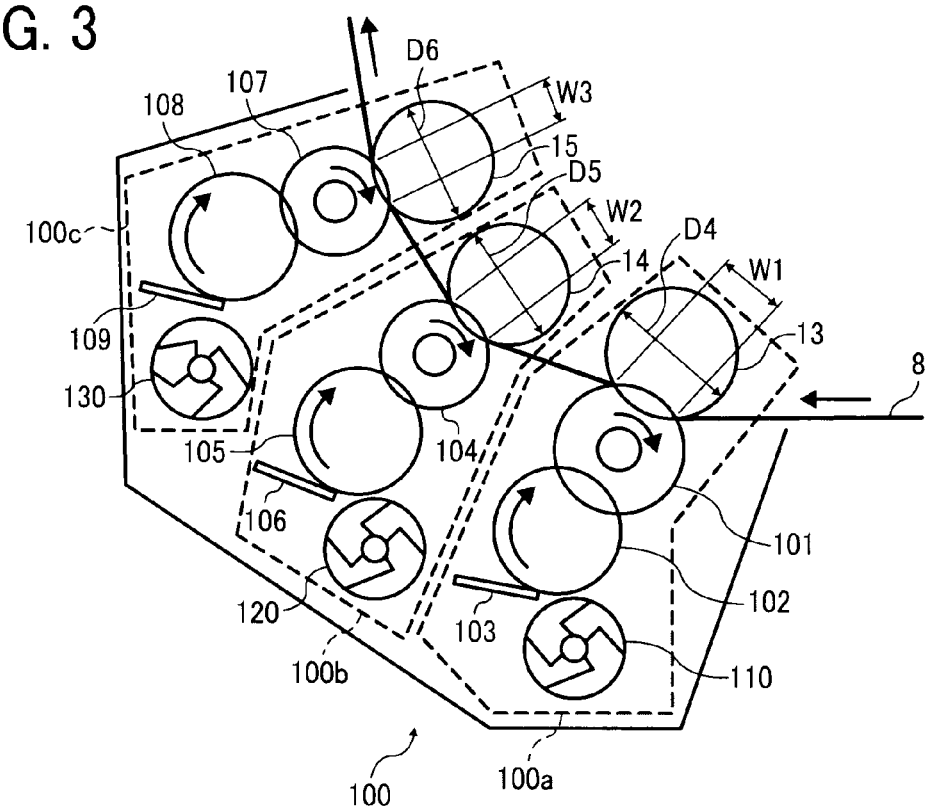
FIG. 3 is a vertical cross-sectional view illustrating an example of a configuration of a belt cleaning device and surrounding components included in an image forming apparatus according to a second illustrative embodiment.

A description is now given of a second illustrative embodiment of the present invention with reference to FIG. 3. FIG. 3 is a vertical cross-sectional view illustrating a configuration of the belt cleaning device 100 and surrounding components according to the second illustrative embodiment.

In the second illustrative embodiment, an outer diameter D4 of the first opposing roller 13 provided opposite the first cleaning brush roller 101 is larger than each of an outer diameter D5 of the second opposing roller 14 provided opposite the second cleaning brush roller 104 and an outer diameter D6 of the third opposing roller 15 provided opposite the third cleaning brush roller 107.

As a result, the contact width W1 is larger than each of the contact width W2 and the contact width W3.

Although the contact width W1 between the first cleaning brush roller 101 and the intermediate transfer belt 8 can be maximized as described above, the product life of the first cleaning brush roller 101 to which the largest amount of toner is conveyed may be shortened compared to the product life of the other two cleaning brush rollers 104 and 107. However, use of the belt cleaning device 100 according to the foregoing illustrative embodiments can provide stable cleaning performance for a longer period of time. As a result, running costs and occurrence of downtime can be reduced.

Polarity control in which negative electric charges are injected into the toner on the intermediate transfer belt 8 by the second cleaning brush roller 104 to give a negative polarity to the toner to be conveyed to the third cleaning brush roller 107 may be performed in the belt cleaning device 100, but need not necessarily be performed.

In addition, in place of the third cleaning part 100*c*, the second cleaning part 100*b* may be provided on the extreme downstream side in the direction of rotation of the intermediate transfer belt 8.

In such a case, polarity control in which positive electric charges are injected into the toner on the intermediate transfer belt 8 by the third cleaning brush roller 107 to give a positive polarity to the toner to be conveyed to the second cleaning brush roller 104 may be performed, but need not necessarily be performed.

Although the positively charged toner on the intermediate transfer belt 8 is removed by the second cleaning brush roller 104 in the belt cleaning device 100 according to the foregoing illustrative embodiments, alternatively, a polarity controller may be provided in place of the second cleaning part 100*b* to give a negative polarity to the toner without removing the toner from the intermediate transfer belt 8.

In such a case, the toner on the intermediate transfer belt 8 passing through the first cleaning brush roller 101 is given a negative polarity by the polarity controller, and is further conveyed to the third cleaning brush roller 107 provided downstream from the polarity controller.

Thus, the negatively charged toner is removed by the third cleaning brush roller 107. In the polarity controller, negative electric charges are injected into the toner on the intermediate transfer belt 8 by, for example, a conductive brush, a conductive blade, or a corona charger.

Further alternatively, the toner on the intermediate transfer belt 8 may be given a positive polarity in place of a negative polarity by the polarity controller to be removed by a cleaning brush roller, to which a negative voltage is applied, provided downstream from the polarity controller in the direction of rotation of the intermediate transfer belt 8.

Even in such a case, much of the toner has already been removed from the intermediate transfer belt 8 by the first cleaning brush roller 101, so that an amount of toner conveyed to the polarity controller is reduced.

Therefore, the toner on the intermediate transfer belt 8 can be reliably given the single polarity by the polarity controller. Accordingly, the toner is electrostatically removed from the intermediate transfer belt 8 by the cleaning brush roller provided downstream from the polarity controller.

Thus, even the untransferred toner image having a larger amount of toner can be reliably cleaned by the belt cleaning device 100.

In the belt cleaning device 100 according to the foregoing illustrative embodiments, the voltage is applied to each of the collection rollers 102, 105, and 108 and the cleaning brush rollers 101, 104, and 107. Alternatively, each of the collection rollers 102, 105, and 108 may include a metal roller, and a voltage may be applied only to the collection rollers 102, 105, and 108.

In such a case, a voltage slightly smaller than the voltage applied to the collection rollers 102, 105, and 108 is applied to each of the cleaning brush rollers 101, 104, and 107 through the contact positions between the collection rollers 102, 105, and 108 and the cleaning brush rollers 101, 104, and 107 due to a potential decrease caused by resistance of the bristles in the cleaning brush rollers 101, 104, and 107.

Accordingly, an electric potential difference is formed between the collection rollers 102, 105, and 108 and the cleaning brush rollers 101, 104, and 107, respectively. As a result, the toner is electrostatically moved from the cleaning brush rollers 101, 104, and 107 to the collection rollers 102, 105, and 108 using an electric potential gradient.

The belt cleaning device 100 according to the foregoing illustrative embodiments is also applicable to a cleaning device that cleans an image carrier other than the intermediate transfer belt 8, such as a photoconductor.

In addition, although the three cleaning brush rollers 101, 104, and 107 are provided in the belt cleaning device 100 according to the foregoing illustrative embodiments, the number of cleaning brush rollers is not limited thereto, and may be greater than three.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cleaning device comprising:

a normally charged toner cleaning member, to which a voltage having a polarity opposite a normal charging polarity of toner is applied, provided in contact with a rotatable cleaning target at a contact position to electrostatically remove normally charged toner from the cleaning target;

a reversely charged toner cleaning member, to which a voltage having the same polarity as the normal charging polarity of the toner is applied, provided in contact with the cleaning target at a contact position upstream from the normally charged toner cleaning member in a direction of rotation of the cleaning target to electrostatically remove reversely charged toner from the cleaning target; and a pre-cleaning member, to which a voltage having the polarity opposite the normal charging polarity of the toner is applied, provided in contact with the cleaning target at a contact position upstream from both the normally charged toner cleaning member and the reversely charged toner cleaning member in the direction of rotation of the cleaning target to electrostatically remove normally charged toner from the cleaning target, the contact position between the pre-cleaning member and the cleaning target in the direction of rotation of the cleaning target having a width wider than each of a width of the contact position between the normally charged toner cleaning member and the cleaning target and a width of the contact position between the reversely charged toner cleaning member and the cleaning target in the direction of rotation of the cleaning target.

2. The cleaning device according to claim 1, wherein an outer diameter of the pre-cleaning member is larger than each of an outer diameter of the normally charged toner cleaning member and an outer diameter of the reversely charged toner cleaning member.

3. The cleaning device according to claim 1, wherein the normally charged toner cleaning member, the reversely charged toner cleaning member, and the pre-cleaning member comprise brush rollers.

4. The cleaning device according to claim 1, wherein the reversely charged toner cleaning member comprises one of a conductive brush and a conductive blade.

5. The cleaning device according to claim 1, wherein the cleaning target is an endless belt.

6. The cleaning device according to claim 1, wherein the cleaning target is a photoconductor.

7. An image forming apparatus comprising a cleaning device, the cleaning device comprising:

a normally charged toner cleaning member, to which a voltage having a polarity opposite a normal charging polarity of toner is applied, provided in contact with a rotatable cleaning target at a contact position to electrostatically remove normally charged toner from the cleaning target;

a reversely charged toner cleaning member, to which a voltage having the same polarity as the normal charging polarity of the toner is applied, provided in contact with the cleaning target at a contact position upstream from the normally charged toner cleaning member in a direction of rotation of the cleaning target to electrostatically remove reversely charged toner from the cleaning target; and a pre-cleaning member, to which a voltage having the polarity opposite the normal charging polarity of the toner is applied, provided in contact with the cleaning target at a contact position upstream from both the normally charged toner cleaning member and the reversely charged toner cleaning member in the direction of rotation of the cleaning target to electrostatically remove normally charged toner from the cleaning target, the contact position between the pre-cleaning member and the cleaning target in the direction of rotation of the cleaning target having a width wider than each of a width of the contact position between the normally charged toner cleaning member and the cleaning target and a width of the contact position between the reversely charged toner cleaning member and the cleaning target in the direction of rotation of the cleaning target.

8. The image forming apparatus according to claim 7, wherein an outer diameter of the pre-cleaning member is larger than each of an outer diameter of the normally charged toner cleaning member and an outer diameter of the reversely charged toner cleaning member.

9. The image forming apparatus according to claim 7, further comprising first, second, and third opposing rollers provided opposite the pre-cleaning member, the normally charged toner cleaning member, and the reversely charged toner cleaning member, respectively, with the cleaning target interposed therebetween, to guide the cleaning target, wherein an outer diameter of the first opposing roller provided opposite the pre-cleaning member is larger than each of an outer diameter of the second opposing roller provided opposite the normally charged toner cleaning member and an outer diameter of the third opposing roller provided opposite the reversely charged toner cleaning member.

10. The image forming apparatus according to claim 7, wherein the normally charged toner cleaning member, the reversely charged toner cleaning member, and the pre-cleaning member comprise brush rollers.

11. The image forming apparatus according to claim 7, wherein the reversely charged toner cleaning member comprises one of a conductive brush and a conductive blade.

12. The image forming apparatus according to claim 7, wherein the cleaning target is an endless belt.

13. The image forming apparatus according to claim 7, wherein the cleaning target is a photoconductor.

* * * * *